US005774892A

United States Patent [19]

Tisdale et al.

[11] Patent Number: 5,774,892

[45] Date of Patent: Jul. 7, 1998

[54] CONVERTIBLE CLOTHING

[76] Inventors: Ephesian Tisdale; Althea Tisdale, both of 6363 Southland Forest Dr., Stone Mountain, Ga. 30087

[21] Appl. No.: 882,477

[22] Filed: Jun. 25, 1997

[51] Int. Cl.[6] ..... A41B 1/12

[52] U.S. Cl. ..... 2/69; 2/227; 2/115; 2/247

[58] Field of Search ..... 2/125, 126, 115, 2/269, 227, 247, 249, 250, 251, 69, 253

[56] References Cited

U.S. PATENT DOCUMENTS

| | | | |
|---|---|---|---|
| 497,727 | 5/1893 | Prentiss | 2/126 |
| 1,066,713 | 7/1913 | Cronin | 2/126 |
| 1,089,999 | 3/1914 | Watts | 2/126 |
| 1,869,261 | 7/1932 | Jennings | 2/247 |
| 2,104,826 | 1/1938 | Stramiellc | 2/126 |
| 2,389,697 | 11/1945 | Stoeckert | 2/247 |
| 4,215,435 | 8/1980 | Miele . | |
| 4,637,075 | 1/1987 | Ingrisano et al. | 2/253 |
| 4,766,613 | 8/1988 | Wells . | |
| 5,153,944 | 10/1992 | Teel . | |
| 5,182,812 | 2/1993 | Goldsby | 2/227 |
| 5,208,920 | 5/1993 | Schaefer et al. . | |
| 5,404,592 | 4/1995 | Jackson . | |
| 5,533,209 | 7/1996 | Davis . | |
| 5,539,932 | 7/1996 | Howard . | |

FOREIGN PATENT DOCUMENTS

| | | | |
|---|---|---|---|
| 518480 | 4/1953 | Belgium | 2/126 |
| 1363957 | 5/1964 | France | 2/227 |
| 2433913 | 4/1980 | France | 2/269 |
| 2449414 | 10/1980 | France | 2/227 |
| 3139463 | 4/1983 | Germany | 2/126 |
| 2271711 | 4/1994 | United Kingdom | 2/227 |

*Primary Examiner*—Gloria M. Hale
*Attorney, Agent, or Firm*—Kenneth L. Tolar

[57] ABSTRACT

The present invention relates to clothing, specifically trousers and a shirt, both of which may be converted to shorts or a short sleeve shirt, respectively, using removably attached lower leg and lower sleeve portions. The attachment means are placed on the exterior of the lower sleeve and leg portions and on the interior surface of the upper leg and upper sleeve portions so that the resulting attachment seams are concealed. A plurality of interchangeable accessory pocket components are provided which may be removably attached to the upper sleeve and leg portions allowing accessory items to be carried thereon regardless of which version of the pants or shirt is being used.

10 Claims, 3 Drawing Sheets

CONVERTIBLE CLOTHING

BACKGROUND OF THE INVENTION

The present invention relates to high fashion clothing comprising trousers and a long sleeve shirt easily convertible to shorts and a short sleeve shirt, respectively. The trousers and shirt have lower leg portions and lower sleeve portions which may be removably attached using strings, Velcro®, buttons, zippers, tabs or similar attachment means. Therefore, the clothing may be quickly and easily converted from winter to summer clothing or vice versa by easily removing or attaching the sleeve or leg portions. Accessory pocket components for storing beepers, coins or other similar devices are removably attached to either of the seasonal pants or shirts as desired.

DESCRIPTION OF THE PRIOR ART

Convertible clothing shown in the prior art generally relates to trousers that can be converted to shorts. Therefore, it is an object of the present invention to provide the combination of both convertible pants and shirts designed to be worn together to form a convertible clothing wardrobe. Also, none of the relevant prior art devices disclose accessory component carrying means removably attached to a convertible shirt or trousers. It is therefore an object of this invention to provide convertible clothing that overcomes these shortcomings.

U.S. Pat. No. 5,404,592 issued to Jackson discloses a method for converting long sleeves to short sleeves. The method comprises folding a long sleeve upwardly about a plastic film cuff stiffener appliance.

U.S. Pat. No. 5,539,932 issued to Howard discloses adjustable length pants having adjustment tabs and adjustment arrays located in the pants leg interior. The pant legs are folded under forming a cuff on the interior surface of which is an adjustment tab. The adjustment tab is then attached to one of the adjustment arrays on the pant leg interior adjacent to the cuff interior surface to form a desired pant length.

U.S. Pat. No. 5,533,209 issued to Davis discloses convertible wearing apparel designed primarily for infants. The garments have cuffs without a hem at their distal end and have hidden side seams. A pouch overlays the cuff which is invertible to enclose appendages such as a hand or foot; or alternatively the pouch may be turned back to expose the appendage.

U.S. Pat. No. 5,208,920 issued to Schaeffer, et al. relates to an adjustable system for garments. The garments are adjusted by pulling a cord until the hem is turned up to the desired length. The garment also has means for smoothing and pressing allowing the adjustment to be undetectable.

U.S. Pat. No. 5,153,944 issued to Teel discloses a method for altering pants so they can be used as either shorts or as long pants.

U.S. Pat. No. 4,766,613 issued to Wells discloses convertible trousers which have lower portions detachably connected to the upper portions using of a pair of pile fastening material strips connected to the inner surface of the upper portions and a pair of hook fastening material strips connected to the outer surface of the lower portions.

U.S. Pat. No. 4,215,435 issued to Miele discloses a convertible trouser having a plurality of interchangeable leg portions that may be arranged in various configurations to produce a garment of variable length and appearance.

As indicated above, none of the above described inventions disclose a method or apparatus for converting long pants to shorts in conjunction with converting long sleeve shirts to short sleeve shirts. Furthermore, none of the above described inventions disclose means for interchangeably, removably attaching accessory pocket components such as coin or beeper holders to the convertible clothing.

SUMMARY OF THE INVENTION

The present invention provides a new clothing system comprising convertible trousers and shirts. The long sleeve shirts may be easily converted to short sleeve shirts and the trousers can be easily converted to shorts as desired. It is therefore and object of the present invention to provide clothing that may be selectively, reversibly converted from summer to winter clothing.

It is yet another object of the present invention to provide convertible clothing having removably attached sleeves and leg portions whereby the attachment seams are easily concealed.

It is yet another object of the present invention to provide convertible clothing having interchangeable accessory pocket components removably attachable thereto. Other objects, features and advantages of the present invention, its details of construction, and arrangement of parts will be seen from the following description of the preferred embodiments and from the appended claims when considered with the attached drawings.

DESCRIPTION OF THE PREFERRED EMBODIMENT

Figure 1:
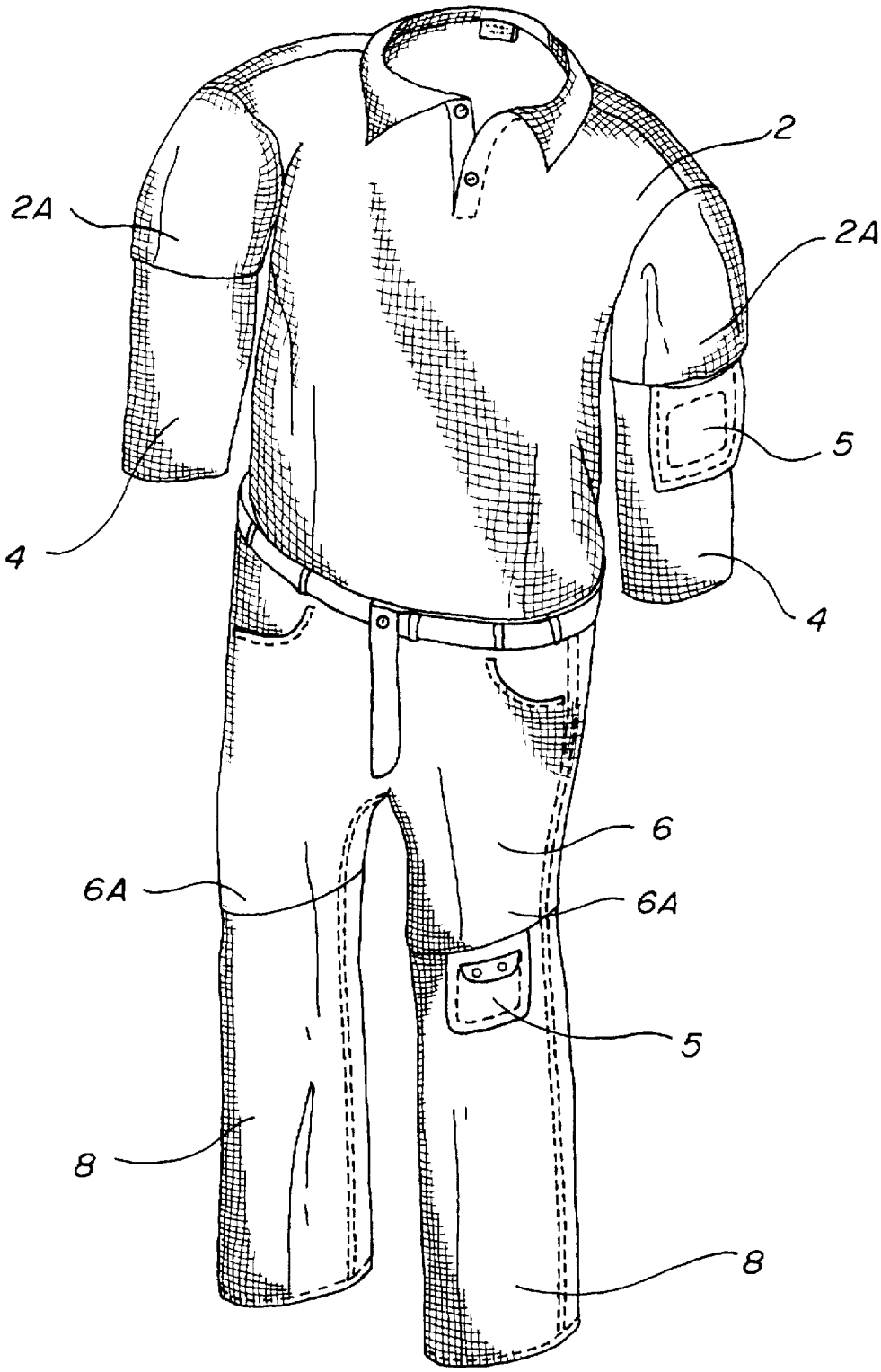
FIG. 1 depicts the convertible trousers and shirt with the removable leg and sleeve portions connected thereto. Also pictured is a typical removable accessory pocket component attached to the upper sleeve and upper leg portions.
Figure 2:
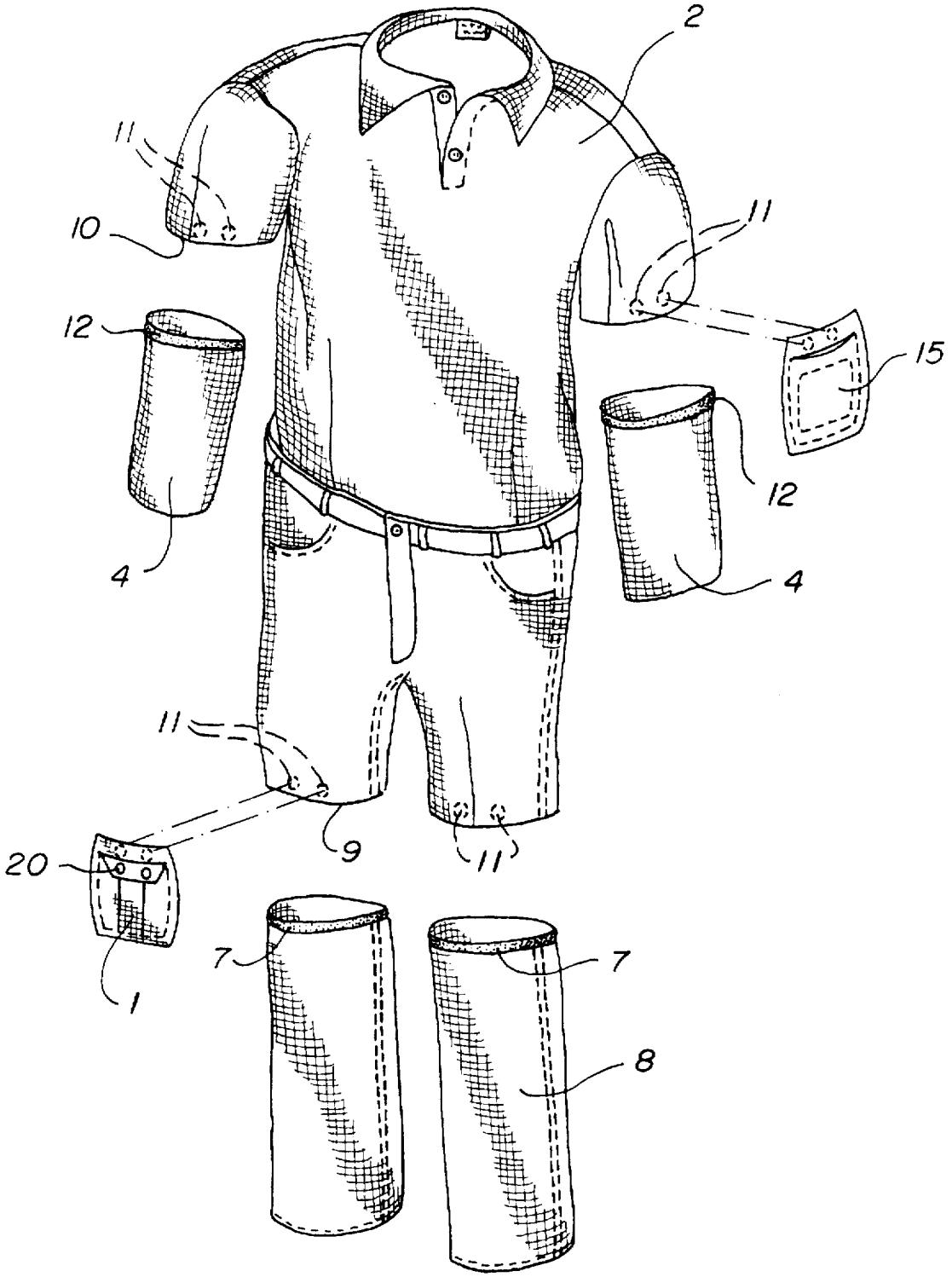
FIG. 2 depicts the convertible trousers and shirt with the lower sleeve and lower leg portions removed therefrom. Also shown is a pair of typical accessory pocket components such as a beeper pocket component or coin pocket component removably attached to a lower sleeve or lower leg portion.

Referring now to FIGS. 1 and 2, the present invention relates to convertible clothing comprising a shirt and trousers. The trousers and shirt component may be manufactured in various sizes, widths and colors using any number of different fabrics or materials. In the preferred embodiment, the trousers and shirt are designed to be worn together thereby resulting in a convertible wardrobe. However, as will be apparent to those skilled in the art to which this invention applies, the shirt and trousers can be worn separately or they may be mixed and matched depending upon the user's taste.

The convertible trousers would comprise and upper pant component 6 having a pair of upper leg portions 6A extending therefrom. The upper leg portions 6A have a distal end, an interior surface and an exterior surface. An attachment means 9 is circumferentially attached to the interior surface each upper leg portion 6A proximal to its distal end.

The convertible trousers also comprise a pair of detachable lower leg portions 8. Each lower leg portion 8 would have first and second ends and interior and exterior surfaces with an attachment means 7 circumferentially attached to the exterior surface proximal to the first end. In the preferred embodiment, the attachment means 7, 9 on both the upper 6A and lower leg portions 8 would comprise a Velcro® strip.

Preferably, a plurality of snaps are used in conjunction with the Velcro® strips to align the lower leg portion 8 with the upper leg portion 6A and the Velcro® strip provides additional strength to the attachment. However, other attachment means such as strings, buttons, zippers, tabs or other similar fasteners may be used as well.

Each lower leg portion 8 is removably attached to the upper leg portion 6A by attaching the Velcro® strip 7 on the exterior of the lower leg portion 8 to the interior Velcro® strip 9 located on the interior surface of the upper leg portion 6A. The Velcro® strips 9 around the periphery of the interior surface of the upper leg portions 6A are placed at a predetermined distance from the distal end so that a segment of upper leg portion 6A material will cover the mating Velcro strip 7 on the lower leg portion 8 and the resulting attachment seam. Therefore, the lower leg portions 8 may be easily removed or reattached allowing the device to be used as trousers or shorts.

The convertible shirt 2 would comprise a shirt component 2 having a pair of upper sleeve portions 2A for receiving a mating detachable lower sleeve portions 4. Each upper sleeve portion 2A has a distal end, an interior surface and an exterior surface. Circumferentially attached to the interior surface of the upper sleeve portion 2A adjacent the distal end is an attachment means 10.

The lower sleeve portion 4 has first and second ends, an interior surface and an exterior surface. An attachment means 12 is circumferentially attached to the exterior of each lower sleeve portion 4. The lower sleeve portion 4 may be removably attached to the upper sleeve portion 2A in a similar fashion as the lower leg portions 8 of the convertible trousers. Also, as with the trousers, the attachment means 10 is placed at a predetermined distance from the distal end of the upper arm portion 2A so as to conceal the resulting attachment seams when the upper and lower sleeve portions are attached. Again, the preferred attachment means is a plurality of snaps to align the detachable lower sleeves 4 with the upper sleeve portions 2A and a Velcro® strip on both the upper and lower sleeve portions to provide resiliency to the attachment.

Any one of a plurality of interchangeable accessory pocket components 5 may be removably attached to either the shirt or trousers as desired. In the preferred embodiment, three possible pocket accessories may be used as shown in FIG. 2, i.e., a sealed pocket 1, a coin pocket 3 and a pager pocket 15. The components each would comprise a substantially rectangular panel having front and back surfaces and four sides. A smaller, substantially rectangular panel having four sides would be attached to preferably the front surface of the first panel using an attachment means around the periphery of and substantially parallel to three of the sides. Securing the second panel in this manner forms a pouch portion for storing an item therein such as a pager. The size of the pouch could be varied to suit a particular application.

The sealed pocket component 1 and the coin pocket component 3 would further comprise a substantially rectangular flap having four sides, with a side permanently attached to the front surface of the first panel adjacent to the second panel. A surface of the flap would have a plurality of closure means 20 such as snaps or similar attachment means for removably attaching said flap to mating attachment means 19 on the exterior surface of said pouch portion. The flap would serve as a removable cover for the pouch portion securing the contents therein.

The pouch portion of the coin holder pocket component 3 would be similar to that of the sealed pocket component 1 described above. In addition, the pouch portion would have a plurality of vertical seams 21, said scams spaced at a predetermined distance from each other and parallel to and between two sides of said pouch, said seams attaching said pouch to the front surface of said first panel to form a plurality of elongated, substantially rectangular compartments for easily storing coins therein.

Each accessory component 5 has a plurality of attachment means such a snap style closures 13, preferably on the back surface near an end. The upper sleeve portions 2A and the upper leg portions 6A each have mating attachment means 11 on their interior surfaces. This arrangement allows the accessory pocket components 5 to be removably attached to the convertible garments regardless of whether the winter or summer version is being used. As will be appreciated by those skilled in the art, many other specialized pocket components may be used with the inventive device and the three pocket components are described above merely as an example of the preferred embodiment and are not intended to be an exhaustive list of possible pocket components. The concept of the herein disclosed convertible clothing can also be applied to infant's or children's clothing, as well as to dresses and skirts using the same concepts and designs described above. For example, a long dress could be easily converted to a short dress and vice versa by having an upper dress portion removably attached to a lower dress portion, an attachment means and means for concealing said attachment means all as set forth above.

From the above description, it is now apparent that the new invention provides new clothing convertible to or from winter or summer apparel. It is understood that although there has been shown and described the preferred embodiment of the described invention, that modifications may be made to the invention which do not exceed the scope of the appended claims. Accordingly, the scope of my invention is to be limited only by the following claims:

We claim:

1. Clothing capable of being selectively converted to summer or winter apparel comprising:

a trouser having an upper pant component, said upper pant component having a pair of upper leg portions extending therefrom, said upper leg portions having a distal end, an interior surface and an exterior surface;

a pair of lower leg portions each having an exterior surface and first and second ends;

means for removably attaching said lower leg portions to said upper leg portions so that said trousers may be reversibly converted to shorts; said means comprising a peripheral strip of;hook and loop fastener on the exterior surface of each of said lower leg portions proximal its first end;

a strip hook and loop fastener around the periphery of the interior surface of said upper leg portions each adjacent a distal end but spaced a predetermined distance therefrom for matably engaging said hook and loop fastener strips on said lower leg portions so that said hook and loop fastener strips on said lower and upper leg portions will be concealed;

detachable means for storing and carrying accessory items on said trouser, said means comprising an accessory pocket component, said pocket comprising a first flat substantially rectangular panel, a second flat substantially rectangular panel having four sides, three of said sides peripherally attached to said first panel, said panel forming a holding pouch having an exterior surface, said first panel having a snap style closure for matably engaging a corresponding snap style closure on the interior surface of an upper leg portion.

2. Clothing according to claim 1 wherein said holding pouch is dimensioned to receive a pager.

3. Clothing according to claim 1 wherein said pocket component further comprises:

a substantially rectangular flap having four sides, one of which is attached to said first panel adjacent to a side of said pouch;

means for attaching a second distal side of a said flap to the exterior surface of said pouch to secure the contents therein.

4. Clothing according to claim 1 further comprising:

a plurality of snaps immediately adjacent each hook and loop fastener strip on the upper leg portion;

a plurality of snaps immediately adjacent each hook and loop fastener strip on the lower leg portions for selectively engaging said snaps on said upper leg portions allowing the upper and lower leg portions to be substantially aligned prior to being permanently joined.

5. Clothing according to claim 3 wherein said pocket component further comprises:

a plurality of vertical, spaced seams between and parallel to two sides of said pouch, each of said seams mutually attached to said pouch and to said first panel to form a plurality of substantially rectangular vertical compartments, each of said compartments dimensioned to receive coins.

6. Clothing capable of being selectively converted to summer or winter apparel comprising:

a shirt component having a body portion for covering the upper torso of a human body;

a pair of upper sleeve portions extending from said body portion, each of said upper sleeve portions having a distal end, an outer surface and an inner surface;

a pair of lower sleeve portions having first and second ends, an inner surface and an outer surface;

means for removably attaching said lower sleeve portions to said upper sleeve portions; said means comprising a hook and loop fastener strip peripherally attached to the outer surfaces of each of the lower sleeve portions each adjacent a first end thereof but spaced a predetermined distance therefrom for selectively engaging a peripheral hook and loop fastener strip on the interior surface of each of said upper arm portions adjacent its distal end and a detachable means for storing and carrying accessory items on said shirt component, said means comprising an accessory pocket component, said pocket component comprising a first flat substantially rectangular panel, a second flat substantially rectangular panel having four sides, three of said sides peripherally attached to said first panel, said second panel forming a holding pouch having an exterior surface, said first panel having a snap style closure for matably engaging a corresponding snap style closure on the interior surface of an upper sleeve portion.

7. Clothing according to claim 6 wherein said a holding pouch is dimensioned to receive a pager therein.

8. Clothing according to claim 6 wherein said pocket component further comprises: a substantially rectangular flap having four sides, one of which is attached to said first panel adjacent to a side of said pouch;

means for attaching a second distal side of said flap to the exterior surface of said pouch to secure the contents therein.

9. Clothing according to claim 8 wherein said pocket component further comprises:

a plurality of vertical, spaced seams between and parallel to the two sides of said pouch, said seams mutually attached to said pouch and to said first panel to form a plurality of substantially rectangular parallel vertical compartments dimensioned to store coins therein.

10. Clothing according to claim 6 further comprising a plurality of snaps peripherally attached to the inner surface of said upper sleeve portions adjacent said hook and loop fastener strips;

a plurality of snaps peripherally attached to the exterior surface of said lower sleeve portions immediately adjacent each hook and loop fastener strip on the lower sleeve portions selectively engaging said snaps on said upper sleeve portions allowing the upper and lower sleeve portions to be substantially aligned prior to being permanently joined.

* * * * *

UNITED STATES PATENT AND TRADEMARK OFFICE

CERTIFICATE OF CORRECTION

PATENT NO. : 5,774,892

DATED : July 7, 1998

INVENTOR(S) : Tisdale, et al

It is certified that error appears in the above-identified patent and that said Letters Patent is hereby corrected as shown below:

Column 2, lines 30-40 should be deleted to appear as follows:

--Figure 1 depicts the convertible trousers and shirt with the removable legs and sleeve portions connected thereto.

Figure 2 is a partially exploded view of the inventive device.

Figure 2A:
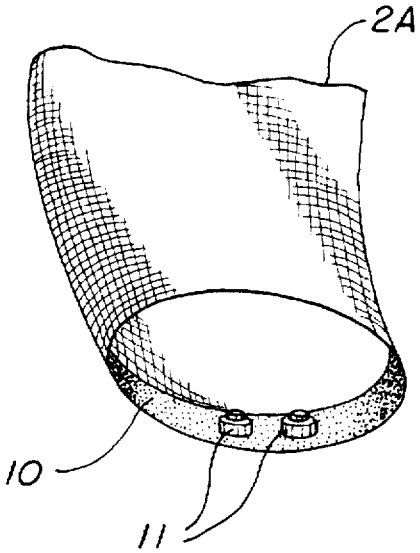

Figure 2A depicts a sleeve portion and the pocket securing means.

Figure 2B:
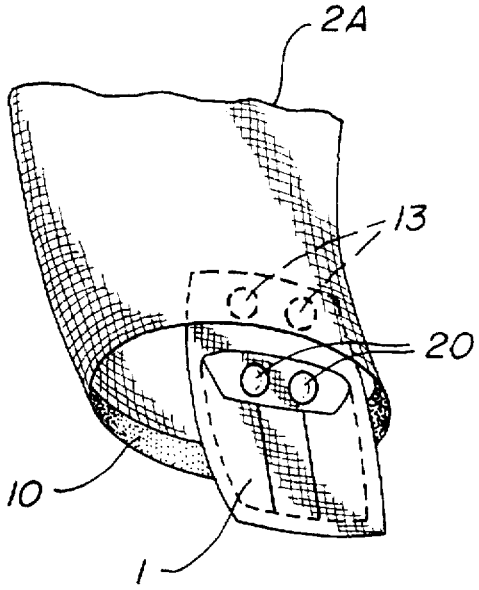

Figure 2B depicts the sealed pocket secured to a sleeve.

Figure 2C:
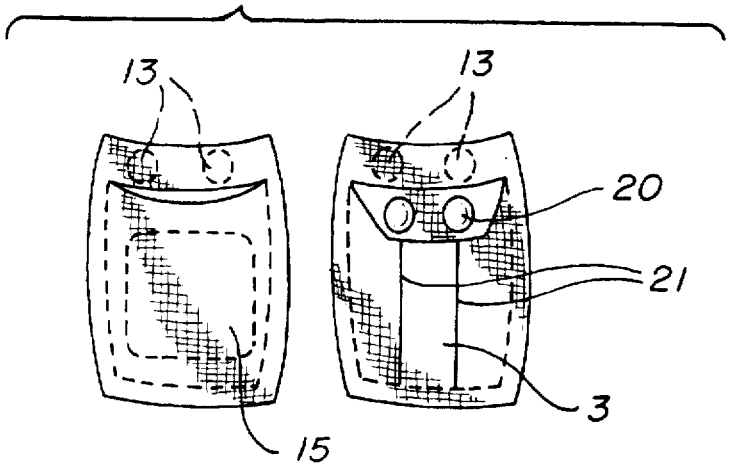

Figure 2C depicts a coin pocket and pager pocket according to the present invention--.

Column 2, line 44, omit "1 and 2", and insert --1 through 2C--.

Column 3, line 46, omit "Figure 2", and insert --Figures 2B and 2C--.

Signed and Sealed this

Ninth Day of February, 1999

*Attest:*

*Acting Commissioner of Patents and Trademarks*

*Attesting Officer*